United States Patent [19]

Kankaanpää

[11] 4,154,645

[45] May 15, 1979

[54] METHOD AND MACHINE FOR MANUFACTURING MULTILAYER PAPER BOARD

[75] Inventor: Matti Kankaanpää, Espoo, Finland

[73] Assignee: Valmet Oy, Finland

[21] Appl. No.: 901,097

[22] Filed: Apr. 28, 1978

[30] Foreign Application Priority Data

Apr. 28, 1977 [FI] Finland ..... 771364

[51] Int. Cl.[2] ..... D21F 1/36; D21F 1/52; D21F 3/02; D21F 11/04

[52] U.S. Cl. ..... 162/133; 162/203; 162/205; 162/217; 162/301; 162/304; 162/305; 162/364

[58] Field of Search ..... 162/133, 203, 205, 211, 162/217, 301, 303, 304, 305, 306, 351, 364

[56] References Cited

U.S. PATENT DOCUMENTS

| | | | |
|---|---|---|---|
| 3,726,758 | 4/1973 | Parker et al. | 162/301 X |
| 3,772,140 | 11/1973 | Kobayashi | 162/133 |
| 3,846,233 | 11/1974 | Kankaanpaa | 162/301 X |
| 3,985,612 | 10/1976 | Watanabe | 162/133 X |
| 3,994,774 | 11/1976 | Halme et al. | 162/301 X |
| 4,033,812 | 7/1977 | Riihinen | 162/301 X |

*Primary Examiner*—Richard V. Fisher
*Attorney, Agent, or Firm*—Steinberg & Blake

[57] ABSTRACT

A method and machine for manufacturing a multilayer paper board which includes an outer web bonded to a base web has the features of initially forming the outer web on a planar section of a single wire where through a suitable structure a first dewatering stage of the web on the single wire is provided, a second dewatering stage being provided by way of a suitable dewatering show subsequent to the first dewatering stage with this second dewatering stage having an initial portion where dewatering takes place simultaneous in opposite directions and a final portion where dewatering takes place only outwardly away from the first wire. A second wire cooperates with the first wire at the second dewatering stage to provide a twin-wire web formation while forming a first sandwich structure which includes the first and second wires and the web therebetween, this first sandwich structure being guided along a convexly curved surface of the dewatering shoe at the second stage of dewatering and then being guided around a forming roll where additional dewatering takes place in a third dewatering stage. This first sandwich structure is guided tangentially from the forming roll and at a location beyond the latter the second wire is detached from the web while the first wire with the web adhering thereto travels to a solidification zone where a third wire which carries the base web is joined to the first wire with the outer web adhering thereto, the latter webs being pressed against each other at the solidification zone while a suitable structure cooperates with the first and third wires to urge toward each other at the solidification zone.

21 Claims, 3 Drawing Figures

METHOD AND MACHINE FOR MANUFACTURING MULTILAYER PAPER BOARD

BACKGROUND OF THE INVENTION

The present invention relates to methods and apparatus for manufacturing multilayer paper board.

In particular, the present invention relates to a method and machine for manufacturing a multilayer paper board which includes an outer web for the resulting cardboard and a base web which is bonded to the outer web.

A considerable favorable experience has been gained from the wire section of a paper machine constructed in accordance with the principles of U.S. Pat. No. 3,846,233. This wire section has proved to be a success in the manufacturing at relatively high speed of various paper grades containing mechanical pulp and fillers. Thus, one of the purposes of the present invention is to exploit the favorable experience gained from the above patent. The principles of the invention are applicable to that field of paper manufacturing which relates to the manufacture of cardboard.

Thus, the present invention relates to methods and apparatus for producing multilayer cardboard. Examples of such cardboard grades are boxboard, carton board and foot-container board. Such cardboard grades can be made, for example, on a triple wire machine in which the webs forming on three Fourdrinier sections are bonded to each other in order to produce a cardboard web of a desired substance. Furthermore, cardboard of this type can be made by machines on which some of the component web layers are made on pick-up cylinders while only a single layer is made on a Fourdrinier wire. Such a Fourdrinier wire section is beneficial with respect to the quality of the cardboard but has the disadvantage of occupying a relatively large amount of space. The wet end formed on a pick-up cylinder is highly advantageous with respect to the utilization of space, but production on such a pick-up cylinder of, for example, a transversely even web of good formation is much more difficult to achieve than would be the case with a Fourdrinier. With respect to formation of webs on a pick-up cylinder, it is extremely difficult to regulate the fiber orientation. On such pick-up cylinders fibers easily tend to settle in the running direction of the machine, which is to say in the direction in which the web flows. This latter phenomenon, which affects the strength and stiffness of the board and which in particular causes a deterioration of transversal stiffness, is highly deterimental in cardboard which is required to be used, for example, in the making of boxes. Furthermore, a web formed on a pick-up cylinder tends to become one-sided, and this factor may hinder the utilization of cardboard at numerous conversion stages.

SUMMARY OF THE INVENTION

It is thus a primary object of the present invention to provide a method and machine for manufacturing multilayer board while avoiding the above drawbacks.

Thus, it is an object of the present invention to provide a method and machine for forming a web to be used in multilayer cardboard in such a way that the space requirements will be roughly the same as the space requirements of a pick-up cylinder unit while allowing the application of some of the essential principles of web formation that are characteristic of a Fourdrinier wire section.

It is in particular an object of the present invention to provide a method and apparatus which enable use to be made of a web-forming unit which is particularly suitable for use as a top former in cardboard machines on which the bottom web and base web are formed on a relatively long Fourdrinier section.

Thus, it is an object of the invention to provide a method and structure which render it possible to manufacture in a highly effective manner an outer layer of a multilayer board in a manner enabling this outer layer to be provided with desirable properties while being formed with a structure which occupies a relatively small space, such as that which would be occupied by a pick-up cylinder unit, and while enabling this outer layer to be bonded to a base web which may be formed on a relatively long Fourdrinier wire section.

In particular it is an object of the present invention to provide a method and machine which enable the properties of the outer web of the multilayer board to be effectively controlled so that this outer web has a structure which lends itself to effective bonding with a base layer while at the same time the exposed surface of the outer web after it is bonded to the base web will be relatively smooth and have properties suitable for receiving printing ink, while at the same time this outer web will by the control of the manufacture thereof have desirable properties with respect to the strength thereof, for example.

Thus, it is an object of the present invention to provide in a method and apparatus as referred to above the possibility of controlling the fiber and filler retention of the outer web as well as the location and orientation of the fiber and filler structure in the outer web in such a way that this outer web of the multilayer board will have highly desirable properties.

According to the invention pulp stock is delivered from a headbox onto a planar section of a first wire where the initial formation of the above outer web takes place while a first dewatering stage is provided at the planar section of the first wire by way of a suitable dewatering means situated within the loop of the first wire immediately subsequent to a breast roll around which the first wire is guided and which is situated at the region where the pulp stock is delivered to the first wire from the headbox. Subsequent to the first dewatering section the first wire is guided along a convex guiding surface of a dewatering shoe which provides a second dewatering stage, the structure of this dewatering show being such that during an initial portion of the second dewatering stage dewatering takes place simultaneously in opposite directions from the web while at the final portion of the second dewatering stage dewatering takes place only outwardly away from the first wire. A second wire is brought into contact with the web at the second dewatering stage to provide for twin-wire formation at the web at the second dewatering stage while providing at this stage a first sandwich structure made up of the first and second wires and the web therebetween, with the dewatering at the second stage taking place outwardly through the second wire. This first sandwich structure is guided subsequent to the second dewatering stage around a forming roll where a third dewatering stage is provided, with the water being at least centrifugally removed from the web at the third dewatering stage outwardly away from the forming roll. This first sandwich structure is then tangentially guided away from the forming roll while at a given distance beyond the latter the second wire is guided away from the web which is maintained in adherence with the first wire by a suitable pick-up means, and this first wire with the web adhering thereto thus travels beyond the second wire.

The first wire with the outer web adhering thereto reaches a solidification zone where the first wire is guided by suitable guide rolls situated within the loop of the first wire, and at the first of the latter guide rolls a third wire with a base web thereon is joined to the first wire with the web adhering thereto in such a way that both of these webs engage and contact each other to become bonded to each other while they travel through the solidification zone. At this solidification zone there is thus formed a second sandwich structure made up of the first and third wires and the webs therebetween, and at the solidification zone the guide rolls for the first wire and additional structure cooperating both with the first and third wires urge the latter toward each other so as to enhance the bonding of the outer web and base web to each other by pressing them against each other.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
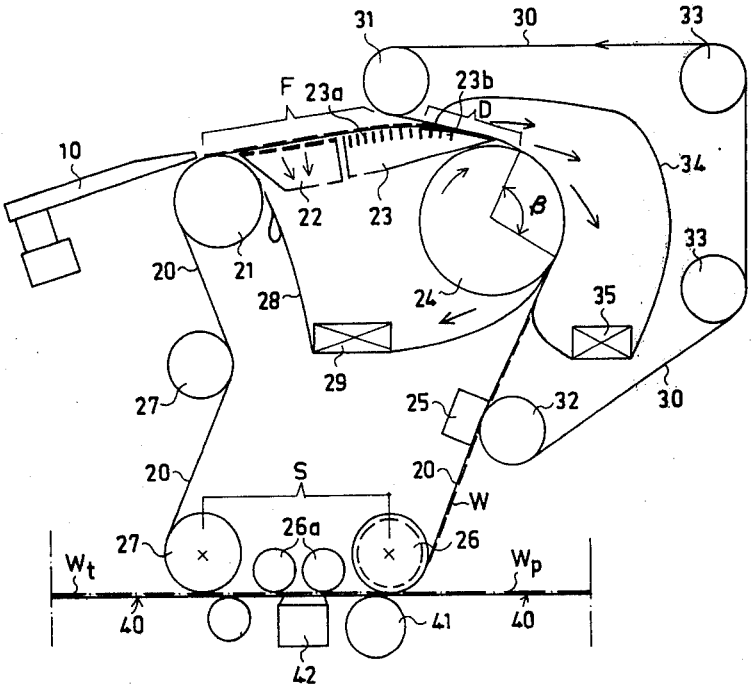
FIG. 1 is a schematic side elevation of a machine structure of the invention for carrying out the method of the invention.

Referring to FIG. 1, it will be seen that the illustrated structure includes a first forming wire 20 which forms a closed loop within which there is situated a breast roll 21 as well as a forming roll means 24. The breast roll 21 can be of any conventional construction utilized for breast rolls. Thus the breast roll 21 may have an open water-receiving surface, but most commonly this breast roll is a solid roll with a smooth exterior surface. The forming roll means 24 may be in the form of a roll having a smooth outer surface, such as a solid roll, or the forming roll means may take the form of a roll having a grooved outer surface or an apertured shell capable of receiving water. This forming roll means 24 also may take the form of a suction roll having one or more suction zones, and it will be seen from FIG. 1 that the forming roll means 24 forms a couch roll for the wire 20.

Inside the loop of the forming wire 20 there are a pair of lower guide rolls 26 and 27 which serve to guide the wire 20 at the lowermost region thereof. The first guide roll 26, considered in the direction of travel of the wire 20, is advantageously a roll with a grooved outer surface so that water may be received thereby. Between the guide rolls 26 and 27 there are one or more rolls **26*a* preferably having a smaller diameter than the rolls 26 and 27 pressing downwardly against the wire 20 to provide also a pressure against a lower wire 40** forming a basic wire carrying a base web as will be apparent from the description which follows.

Figure 2:
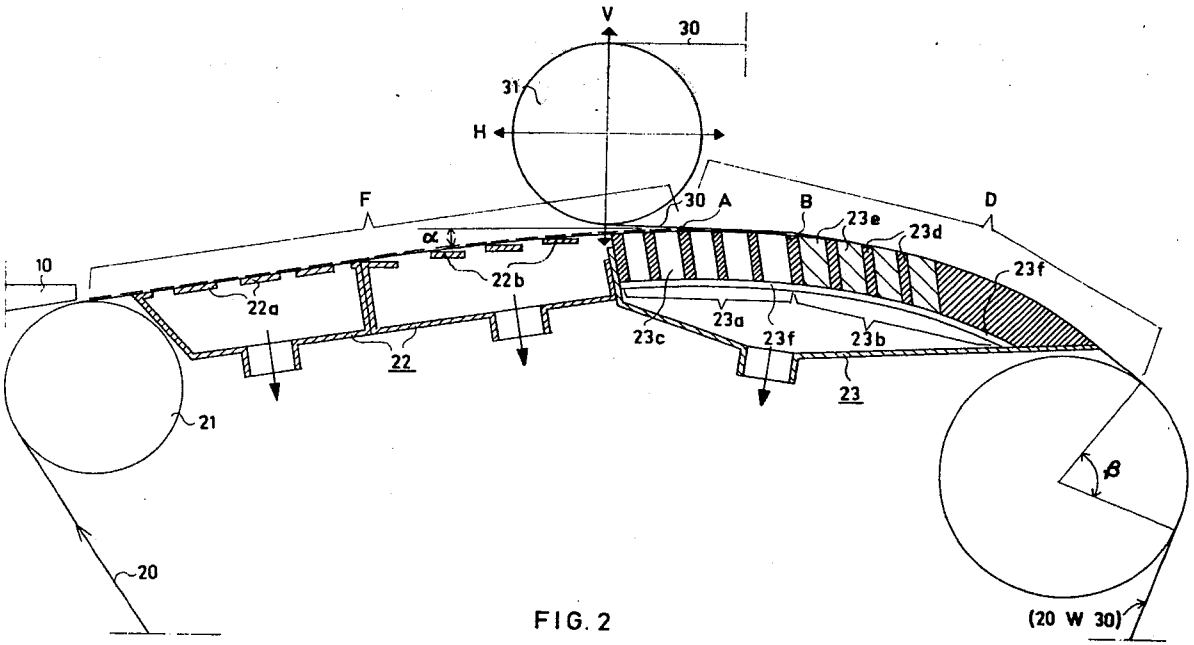
FIG. 2 is a fragmentary sectional elevation showing part of the structure of FIG. 1 at an enlarged scale, as compared to FIG. 1, while also showing further details of the structure.

As is indicated in FIGS. 1 and 2, within the loop of the forming wire 20 there are situated between the breast roll 21 and the forming roll means 24 a first dewatering means 22 and next to the latter extending therefrom to the forming roll means 24 a second dewatering means 23. The dewatering means 22 which extends from the region of the breast roll 21 up to the dewatering means 23 preferably takes the form of a forming table, the top wall structure of which may be solid, perforated, or slotted as indicated by the transverse portions **22*a* in FIG. 2. The width of these wall portions 22*a* of the forming table may vary and in addition the number thereof may vary, so that a particular dewatering means 22 will have a selected number of slots passing through the top wall thereof. The surface of the forming table is preferably plane, and of course the pulp stock delivered from the headbox means 10 onto the wire 20 undergoes initial web formation at a planar section of the wire 20 which travels beyond the breast roll 21 along the upper surface of the forming table 22. The region of the table 22 adjacent the breast roll 21 has the above slotted structure. Beyond this latter region, however, the dewatering means 22 has the portion 22*a* followed by an upper wall portion 22*b* providing a foil-topped table section as shown most clearly in FIG. 2. The dewatering on the open-surface forming table most conveniently occurs freely, but according to a preferred arrangement suction means can be applied, such a suction means being indicated by the arrows shown in FIG. 2 extending downwardly through openings defined by tubular portions which project from the lower wall portions of the housings which form the dewatering means 22 and which have the upper wall structure 22*a* and 22*b*, as described above. As is shown in FIG. 1, the removed run-off water is delivered to a saveall 28 from which a discharge channel 29** extends to carry off the water therefrom.

As will be apparent from the description below, the dewatering means 22 provides a first dewatering stage, while the second dewatering means 23 provides a second dewatering stage, and the dewatering means 23 which follows the forming table 22 is in the form of a wire-guidng shoe made up of a wet suction box and a wire guiding shoe proper. The length of the first dewatering stage provided by the dewatering means 22, measured in the direction of wire travel, is about the same as the length of the dewatering means 23. The upper part of the wet suction box section of the dewatering means 23 consists of foil-like ribs. The top of the wire guide illustrated is solid. The dewatering element 23 is curved throughout its upper surface so as to have a convexly curved upper surface which guides the wire 20. The section with the ribbed top is of a structure which allows the slots defined between the ribs to be filled with special blocks or other filling ribs. Thus, the slot-topped dewatering element becomes solid-topped, and the solid-topped section of the dewatering element can thus be increased as desired. In other words, as shown in FIG. 2, the transverse ribs of the dewatering shoe 23 define between themselves the slots **23*c* while the final portion of the dewatering means 23 is solid as illustrated. As is apparent from FIG. 2, the ribs 23*d* which define the slots 23*c* between themselves extend down to longitudinally extending flanges 23*f*, a pair of which are provided at the opposite lower regions of the transversely extending ribs 23*d*. The blocks 23*e*** may be introduced into the slots 23c, filling and closing a number thereof extending to the left from the solid end portion of the top wall of the dewatering means 23, as illustrated in FIG. 2, and thus it is possible to control that portion 23a through which water can travel into the interior of the dewatering means 23 to be sucked out of the latter, for example, and the succeeding portion 23b which is solid so that only dewatering centrifugally outwardly away from the dewatering means 23 in an upward direction can take place at the portion 23b thereof, with respect to the lengths thereof, so that by controlling the lengths of the portions 23a and 23b it is possible to regulate an initial portion of the second dewatering stage, provided by the dewatering means 23, where dewatering takes place simultanesouly in opposite directions, as will be apparent from the description which follows, and the final portion 23b where dewatering takes place outwardly away from the wire 20.

The web forming unit includes in addition to the above first wire 20, a second wire 30 which forms a second closed loop in which there is situated a top breast roll 32 the position of which may be adjusted, and within this second loop formed by the wire 30 there are also several guide rolls 32 and 33. This top breast roll or guide roll 31 for the second wire 30 is most appropriately situated roughly at the section between the first and second dewatering means 22 and 23, although its position can be regulated as described below. Within the loop of the wire 30 there is also a water-collecting trough 34 forming a saveall from which water is discharged by way of a pipe 35. It will be seen that between the guide roll 31 and the return guide roll 32 for the wire 30, the second wire 30 forms with the wire 20 a twin-wire forming section, with the wire 30 lapping the return guide roll 32 to be guided by the guide rolls 33 back to the guide roll 31. A pick-up means 25 is provided within the loop of the wire 20 opposite the return guide roll 32 for causing the web W to adhere to the wire 20 and to continue to travel therewith downwardly beyond the roll 32. This pick-up means 25 is in the form of a suitable suction box. The wire 20 with the web W adhering thereto then laps a guide roll 26 which together with an additional guide roll 27 are situated within the loop of the wire 20. Of course the wire 20 laps the lower guide roll 27 shown in FIG. 1 to return therefrom to the breast roll 21, being guided by an additional guide roll 27 as illustrated in FIG. 1. At the guide roll 26 a third wire 40 joins the wire 20 to form therewith a common path of travel between the guide roll 26 and the lower guide roll 27, this wire 40 carrying a basic web $W_p$ which engages and becomes bonded to the web W as these webs travel along the solidification zone S indicated in FIG. 1, with the wire 20 and 40 forming with the webs W and $W_p$ therebetween a second sandwich structure, the first sandwich structure of course being formed by the wires 20 and 30 with the web W therebetween during the twin-wire formation of the web W. Thus, between the guide roll 26 and the lower guide roll 27 the second sandwich structure has for the components thereof a common path of travel along which there are situated a lower guide roll or suction box 41 engaging the lower surface of the wire 40 as well as an additional suction box 42, these components 41 and 42 being situated within the loop of the basic wire 40 so as to contribute to the solidification of the second sandwich structure, and the composite web $W_t$ continues to travel while being supported only by the wire 40 beyond the lower guide roll 27 shown in FIG. 1.

As is apparent from the above description, the web-forming unit has first a single-wire web forming zone F which preferably is planar, and thereafter a second forming zone D where twin-wire formation takes place, this second zone D being followed by a web-solidification zone at the forming roll means 24, after which the wires 20 and 30 separate from each other with the web W continuing to travel with the wire 20 so as to enter the solidification zone S where the base web $W_p$ is joined to the outer web W.

A more detailed description of the functioning of the process and web-forming unit of the invention follows.

In accordance with the invention, the dewatering of the web W, which will form the outer web, takes place in three stages, in such a way that in the first two stages at least, the structural features such as base formation, fiber orientation and strength, stiffness in particular, can simultaneously be influenced in a desired manner.

The first dewatering stage occurs immediately subsequent to the headbox 10 on the single-wire starting section F of the web former, the functioning of which is basically similar to that of a normal Fourdrinier wire section. This section F may be equipped with conventional dewatering elements used on Fourdrinier wires, such as, for example, a breast board, a forming board, foils, or various combinations thereof. By way of such structures the dewatering takes place gently so as to insure the most complete possible fine-substance and filler retention, these latter factors being extremely important for the optical and printability features of the web W. At this starting section F of the web forming unit there also takes place adjustments well known to practical paper makers, such as adjusting the relationship between the speed of the stock jet issuing from the headbox 10 and the speed of the wire, the adjustment of the direction of the stock jet discharged from the headbox 10, adjustment of the dewatering rate in the very first meters of the wire 20 travelling beyond the breast roll 21, etc. By way of such adjustments it is possible to affect the formation of the base of the fiber web W and the orientation of the fibers upon which the stiffness and the bulk of the cardboard are dependent.

The section of the run of the wire 20 where the first dewatering stage F is provided will most conveniently be a planar section. Advantageously, this section may be inclined slightly so as to extend upwardly from the breast roll 21, as indicated by the angle $\alpha$ shown in FIG. 2. By way of this inclination it is possible to increase the possibility for controlling the fiber orientation.

The second dewatering stage begins immediately after the end of the first dewatering stage F where the straight or planar section of the wire is located. In the second dewatering stage the second dewatering means 23 acts, this dewatering means 23 extending across the entire width of the machine and having a special construction with an upper convexly curved surface which engages the lower surface of the wire 20. As set forth above the dewatering means 23 has the initial portion 23a which is ribbed and the solid portion 23b through which water cannot travel downwardly through the wire 20. At the area of action of the second dewatering means 23, the second wire 30 is guided over the wire 20 and engages the web W thereon to provide the twin-wire formation. From the roll 31 the wire 30 is inclined downwardly toward the wire 20 to define therewith a wedge-shaped gap. The angle with which the top or seond wire 30 meets the lower or first wire 20, which is to say the gap angle, depends upon the position of the guide roll 31 situated within the loop of the wire 30 closest to the forming shoe 23. The position of the roll 31 can be adjusted horizontally, longitudinally of the wire 20, by way of the adjusting means H indicated by the horizontal double-headed arrow, and the position of the roll 31 can also be adjusted vertically, by way of the vertical adjusting means V also indicated by a double-headed arrow. This vertical adjustment of the position of the roll 31, in turn, determines the compression exerted gradually upon the wet web W within the area of the forming shoe 23.

The dewatering that occurs in the area of dewatering means 23 is dependent, in terms of quantity and direction, upon the structure of the dewatering means 23. As described above, the initial portion 23*a*, considered in the direction of wire travel, is slotted as by having the illustrated rib construction, while the final portion 23*b* is solid. The ribs 23*d* extend across the entire width of the wire, defining between themselves the slots 23*c* through which water may be removed, these slots having a particular geometric size and shape. The slots are regularly spaced so that the filler blocks or ribs 23*e* which are supplied as spare parts can be selectively situated in the slots 23*c* resting on the rails or flanges 23*f* as described above. Thus by way of the blocks 23*e* it is possible to close a selected number of slots so as to regulate the length of the portion 23*b* which is solid, and thus it is possible to alter the location B which forms the junction between the initial portion 23*a* and the final portion 23*b* of the second dewatering stage D. Thus, the amount and direction as well as the distribution of the dewatering can be effected in a desired manner by means of the structure of the top wall of the dewatering means 23.

The wires 20 and 30 together with the web W therebetween form a first sandwich structure, and dewatering can take place outwardly through the second wire 30, in a direction opposite to that occurring at the first dewatering stage F which precedes the second dewatering stage D where the dewatering means 23 is located. To the extent that the top wall of the dewatering means 23 has a slotted portion, the dewatering takes place at this latter portion in two directions simultaneously, while at the solid top wall portion forming the final dewatering portion 23*b* of the second stage D, dewatering can only take place outwardly through the second wire 30. The symmetrical and gentle dewatering which can be provided in this way insures homogeneity of the fiber structure of the web.

By the above reversal of the direction of dewatering, subsequent to the first stage F, during the second stage D, the considerable advantage is achieved that the fine fibers and filling substances in the stock, which during the first dewatering stage F have become enriched at the lower surface portion of the web W, cannot escape to any extent from the web W. Considering that this particular web W is that one layer of the final board which will form the outer surface of the cardboard, this bottom surface region of the web W which forms at the first and second dewatering stages will become the outer surface of the finished cardboard, and the smoothness and printing properties thereof are of considerable importance.

For the sake of simplicity, for example, one-quarter to one-third of the dewatering element 23 may be permanently solid, at the final portion 23*b*, while the remainder of the top wall of the dewatering means 23 may be slotted but can be converted into a solid region in the manner described above.

Inasmuch as the dewatering means 22 and the dewatering means 23 are basically of equal lengths in the direction of wire travel, it follows that from one sixth to one eighth (12–17%) of the total dewatering length (F+D) between the breast roll 21 and the forming roll 24 permanently had a solid top which however can be lengthened or shortened in the manner described above by filling the slots 23*c* defined between the ribs 23*d* with a selected number of blocks 23*e* which fill those slots which extend to the left from the permanently solid portion of the top wall of the dewatering means 23, as viewed in FIG. 2, so that it is possible to provide a solid top wall portion for the dewatering means 23 which may extend up to as much as 30 or 40% of the total dewatering length of the first and second dewatering stages F and D. The normal length provided by the dewatering means 22 at the area where dewatering occurs in only one direction, which is to say downwardly through the forming wire 20, represents approximately 50% of the entire length of the first and second dewatering stages F and D. The length of this parallel portion of the dewatering zone can, however, be extended into the initial part of the area of the dewatering means 23 to some extent by way of the horizontal and vertical adjusting means H and V operatively connected to the top breast roll 31 which forms the left upper guide roll for the second wire 30, as viewed in FIG. 1.

Figure 3:
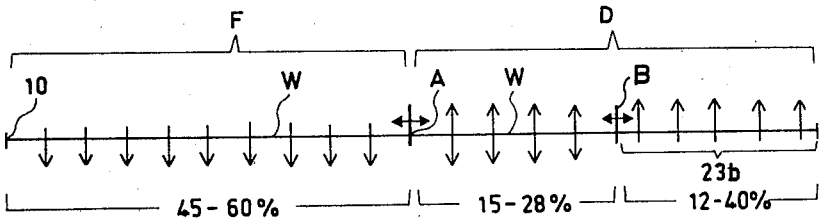
FIG. 3 is a diagrammatic representation of the manner in which dewatering takes place during first and second dewatering stages provided by the method and machine of the invention.

In summary, as may be seen from FIG. 3, it will be found that various possibilities of constructing the dewatering stages between the breast roll 21 and the forming roll 24 are provided, with a view to achieving dewatering stages of different types, as follows:

(1) dewatering essentially downwardly through the forming wire 20 in a single direction for a distance of approximately 45–60% of the entire dewatering area formed by the first and second stages F and D, up to the point A shown in FIG. 3

(2) dewatering symmetrically through the two wires 20 and 30 over approximately 15–28% of the total dewatering length of the first and second stages, up to the point B shown in FIG. 3

(3) dewatering only through the top or second wire 30, over approximately 12–40% of the total length of the first and second dewatering stages.

As has been clarified above, the positions of the points A and B in FIG. 3, and thus the lengths of the dewatering areas, can be altered within the limits set forth above.

The process of web formation which occurs in the area of the dewatering means 23 is also important in the sense that at this area it is possible to affect not only the structure of the web W but also the "topographic" features of the top surface of the web W. This particular web W will form that layer of the cardboard which at a later stage will be bonded to the base web $W_p$, and it will then be necessary that the upper layer of the component web will come against the base web $W_p$, so that this contacting of the webs should be brought about in such a way as to promote the bonding of these layers to each other.

It is possible to affect the features of the upper surface of the web W, which is the surface which will directly contact the base web $W_p$, not only by regulating the dewatering occurring at the dewatering means 23, in the manner described above, but also by selecting for the top wire 30 a wire with a texture which will give a desired surface to the web W.

The sector of the forming roll means 24 which is lapped by the first sandwich structure formed by the wires 20 and 30 and the web therebetween serves as a third dewatering stage. At the forming roll means 24 the web W will be subjected to a relatively great pressure between the forming wires 20 and 30, and the extent or strength of this particular pressure depends upon the tension or tightness of the second wire 30.

The surface and structural features of the Web W are thus partly determined by the type of wire 30 which is utilized and partly determined by the above pressure which is exerted on the web when the first sandwich structure laps the forming roll means 24. As a result of this pressure, water will again be separated out of the web W and will then flow outwardly away from the forming roll means 24 as a result of centrifugal force, this being the only type of dewatering at the forming roll means 24 in the event that the forming roll means 24 is a solid roll. However, the forming roll 24 may be in the form of a perforated couch roll, which allows water to be removed into the interior of the roll, so that at the forming roll means 24 it is possible for the dewatering to take place simultaneously in opposite directions through the wires 20 and 30. The quantity of water which is removed at this particular zone is relatively small, however, compared to the water which is removed at the previous first and second dewatering stages. However the third dewatering stage provided at the forming roll means 24 is of critical importance with respect to solidifying the structure of the web W.

In the event that a significant amount of water remains for removal from the web W at the third dewatering stage, as a result of the operating conditions of the web-former unit, primarily its great speed or the thickness of the web W, and if the structure of the roll 24 is that of a solid roll or solid shell, it can be seen that at the point where the wire 20 and 30 travel away from the surface of the roll 24, a powerful suction effect will occur in the gap which forms between the outer surface of the roll 24 and the wire 20, and as a result a water film will form on the roll 24. This film can be removed by a suitable doctor which is not illustrated and which is situated at the gap which is defined between the roll 24 and the wire 20 where the first sandwich structure travels beyond the roll 24.

Thus, the first sandwich structure formed by the wires 20 and 30 and the web W therebetween travels downwardly beyond the forming roll means 24 at an angle of approximately 90°-60° with respect to a vertical plane, with the wire 30 being separated from the web W which then is bonded to the base web $W_p$ as pointed out above. The bonding of these webs to each other takes place while the second sandwich structure referred to above travels primarily in a horizontal direction. However, these directions are not critical, particularly with respect to the method of the invention.

At a suitable location between the guide roll 26 and the forming roll 24, the second wire 30 is separated from the first sandwich structure by way of the return guide roll 32. However, without changing its direction, the first wire 20 continues to travel tangentially between the rolls 24 and 26 so as to deliver the web W to the base web $W_p$. At the place where the second wire 30 separates from the web W, the suction box 25 within the loop of the wire 20 insures that the web W adheres to the wire 20 while continuing to travel downwardly therewith.

The web W is bonded to the base web $W_p$ by urging the first wire 20 and the third wire 40 toward each other, this action which presses the web W against the base web $W_p$ being provided in part by way of the guide roll 26 within the loop of the wire 20. Thus at this location the bottom surface of the wire 40 has the pressure of a suction box or roll 41 applied thereto, in an upward direction, this roll 41 advantageously being a water-receiving roll such as a grooved roll, thus making it possible that the bonding nip between the webs is rendered "soft" without risk of crushing the web structure.

In the bonding nip defined between the rolls 26 and 41 the second sandwich structure is created, this structure including the wires 20 and 40 and the webs therebetween as pointed out above. The distance between the guide roll 26 and the lower guide roll 27 will determine the length of the solidification zone S which is the region where these composite web $W_t$ is formed. The bonding of the outer web W to the base web $W_p$ is insured at the zone S by utilizing certain auxiliary devices.

Thus, a suction box 42 as well as the roll 41 are situated within the loop of the base wire 40. This structure may, however, with advantage be replaced by a belt suction fan which is not illustrated and the design of which is known to those skilled in the art. Thus the belt suction fan will consist, as is known, of a perforated rubber belt or mat provided with interior suction boxes.

Within the loop of the wire 20 there are one or more auxiliary rolls **26*a* situated between the roll 26 and the lower roll 27, these auxiliary rolls 26*a* serving also to contribute to the compression of the second sandwich structure so as to contribute also to the bonding of the outer web W to the base web $W_p$. The purpose of the auxiliary rolls 26*a* which cooperate with the suction box 42** is to insure that no peeling will occur, which is to say that the component cardboard layers W and $W_p$ will not come apart.

Of course, the invention is not limited to the details set forth above inasmuch as these details may vary within the scope of the protection which is defined by the claims which follows.

What is claimed is:

1. In a method for manufacturing a multilayer board having an outer web bonded to a base web, the steps of directing pulp stock from a headbox onto a planar section of a first wire to bring about the initial formation of said outer web, while providing a first dewatering stage at said planar section of said first wire, said first dewatering stage including the step of dewatering the web at said first stage on said planar section of said first wire in a direction toward and through said first wire at said planar section thereof, guiding said first wire immediately subsequent to said planar section thereof where said first dewatering stage is located along a convexly curved surface of a dewatering shoe while providing at said dewatering shoe a second dewatering stage while said first wire travels along a curved path determined by the curved convex surface of said dewatering shoe, and contacting the web which forms on the first wire while it travels along said dewatering shoe with a second wire which together with the first wire provides for twin-wire formation of the web at said dewatering shoe with a first sandwich structure being formed by said first and second wires and the web therebetween, and providing during the second dewatering stage at said dewatering shoe during an initial portion of said second stage dewatering a simultaneous dewatering of the web in opposite directions through said first and second wires, and then providing during the second dewatering stage a final dewatering portion only outwardly through said second wire, then guiding the first sandwich structure, formed by the first and second wires and the web therebetween, immediately subsequent to said second dewatering stage, along the convex surface of said dewatering shoe, to a third dewatering stage around a forming roll while partially lapping the latter with said first sandwich structure for compressing the web between said first and second wires during said third dewatering stage while they travel with the web around said forming roll, for solidifying the web during said third dewatering stage while directly engaging the forming roll with said first wire and providing for dewatering at said third dewatering stage at least centrifugally outwardly away from said forming roll through said second wire, then continuing the travel of said first sandwich structure away from and beyond said forming roll along a path extending tangentially from said forming roll to separate the first sandwich structure from said forming roll while the first sandwich structure travels along said tangential path beyond said forming roll, then, at a given distance beyond said forming roll, separating said second wire from said outer web while causing the latter to remain adhering to said first wire at a given separating location and continuing the travel of said first wire and the web adhering thereto along said tangential path while returning the second wire to said second dewatering stage, so that only said first wire and the outer web adhering thereto continue to travel along said tangential path beyond said separating location, then, at a given distance beyond said separating location, bringing into contact with said web adhering to said first wire a base web carried by a third wire which forms with the first wire and the outer web adhering thereto and the base web adhering to said third wire and contacting said outer web a second sandwich structure, and providing for the second sandwich structure a common path of travel which is common to the first and third wires and webs therebetween, and while said second sandwich structure travels along said common path of travel urging said first and third wires toward each other to compress the webs therebetween against each other for bonding said outer web to said base web while solidifying the bond between said webs at a solidification zone formed by at least part of said common path of travel.

2. In a method as recited in claim 1 and including the step of providing for said planar section of said first wire at said first dewatering stage a path of travel which is at least slightly inclined in an upward direction.

3. In a method as recited in claim 1 and including the step of providing for said first wire at said first and second dewatering stages paths of travel which have substantially equal lengths.

4. In a method as recited in claim 3 and wherein the initial and final portions of said second dewatering stage are approximately equal in length so that approximately the first half of the second dewatering stage constitutes said initial portion thereof and the second half of said dewatering stage constitutes the final portion thereof.

5. In a method as recited in claim 4 and including the step of adjusting the lengths of said initial and final portions of said second dewatering stage for controlling the properties of said outer web.

6. In a method as recited in claim 4 and including the step of providing for said first dewatering stage a path of travel whose length is in a range of 45–60% of the total path of travel of said first and second dewatering stages, said initial portion of said second dewatering stage having a length in a range of 15–28% of said total path of travel, while said final portion of said second dewatering stage has a length of 12–40% of said total path of travel.

7. In a method as recited in claim 1 and including the step of providing for said outer web by way of the texture of said second wire surface properties which will enhance the bonding of said outer web to said base web.

8. In a method as recited in claim 1 and including the step of providing at said third dewatering stage not only centrifugal dewatering outwardly through said second wire but also dewatering inwardly toward the interior of said forming roll.

9. In a method as recited in claim 1 and including the step of guiding said first and third wires at said solidification of said common path of travel with structure which not only urges said first and third wires toward each other but which also provides for dewatering at said solidification zone.

10. In a method as recited in claim 1 and including the step of separating said first wire from said outer web at the end of said solidification zone while continuing to transport the bonded webs beyond said solidification zone with the bonded webs supported only by said third wire and while returning said first wire back to said first dewatering stage and guiding said first wire at the initial part of said first dewatering stage around a breast roll beyond which said planar section of said first wire travels along said first dewatering stage.

11. In an apparatus for manufacturing a multilayer board including an outer web and a base web to which said outer web is bonded, a first wire forming a closed loop, a breast roll situated within said closed loop of said first wire and lapped in part by said first wire with the latter having a planar section travelling beyond said breast roll, headbox means situated at the region of said breast roll for depositing onto said first wire pulp stock which travels with said first wire beyond said breast roll at said planar section of said first wire to bring about the initial formation of said outer web, first dewatering means situated within said loop of said first wire adjacent said breast roll and extending beyond the latter along said planar section of said first wire to form a first dewatering stage at said planar section of said first wire with dewatering taking place through said first wire toward the interior of said loop thereof at said first dewatering stage, second dewatering means situated within said loop of said first wire next to and extending beyond said first dewatering means for forming a second dewatering stage for the web which forms on said first wire, said second dewatering means having a curved convex surface engaging and guiding said first wire along a curved path during said second dewatering stage, and said second dewatering means providing during an initial portion of said second dewatering stage dewatering simultaneously in opposite directions through said first wire and outwardly away from the latter and during a final dewatering portion of said second dewatering stage dewatering only outwardly away from said first wire, forming roll means situated within said loop of said first wire next to said second dewatering means and lapped in part by said first wire beyond said second dewatering means with said forming roll means forming a couch roll for said first wire, a second wire forming a second closed loop and contacting the web forming on said first wire at the region where said first wire is guided by said second dewatering means and forming roll means so that a twin-wire formation of the web takes place at said second dewatering means and forming roll means with dewatering outwardly away from said first wire taking place through said second wire at said second dewatering stage and by centrifugal force at said forming roll means, a first guide roll situated within the loop of said first wire beyond said forming roll means for guiding said first wire between said forming roll means and first guide roll along a path extending tangentially with respect to said forming roll means and first guide roll, a return guide roll situated within said second loop between said forming roll means and first guide roll and lapped by said second wire so that at said return guide roll said second wire travels away from said first wire to return to the latter at said second dewatering stage, said first and second wires and the web between forming a first sandwich structure travelling along said second dewatering stage, around said forming roll, and up to said return guide roll, pick-up means situated in the loop of said first wire next to the latter opposite said return guide roll for maintaining the web in contact with said first wire to travel with the latter to said first guide roll while said second wire is separated from said web at said return guide roll, a third wire, which carries a base web, being also guided by said first guide roll for placing said base web in contact with said outer web which adheres to said first wire while forming at said first guide roll a second sandwich structure made up of said first and third wires and said outer and base webs therebetween, a second guide roll situated within the loop of said first wire beyond said first guide roll and said second sandwich structure being guided tangentially between said first and second guide rolls to define between the latter a solidification zone where said webs are pressed together and bonded to each other, and means engaging said third wire and cooperating at least with said first and second guide rolls for urging said first and third wires toward each other to enhance the bonding of said webs to each other at said solidification zone.

12. The combination of claim 11 and wherein said first wire returns from said second guide roll to said breast roll while said third wire travels beyond said solidification zone with the bonded webs carried thereby.

13. The combination of claim 12 and wherein between said first and second guide rolls an additional guide means cooperates with said first and third wires for urging the same toward each other.

14. The combination of claim 13 and wherein at least part of the structure contacting said first and third wires at said solidification zone forms a dewatering means for providing for further dewatering of the web at said solidification zone.

15. The combination of claim 11 and wherein said planar section of said first wire at said first dewatering stage is slightly inclined upwardly from said breast roll.

16. The combination of claim 11 and wherein said second dewatering means includes at said initial portion of said second dewatering stage a wall engaging said first wire and formed with a plurality of transversely extending slots through which dewatering takes place at said initial portion of said second dewatering stage through said first wire, said second dewatering means having at said final portion of said second dewatering stage a solid wall engaging said first wire.

17. The combination of claim 16 and wherein a plurality of blocks are selectively located in a selected number of said slots adjacent to said solid portion of said wall of said second dewatering means for adjusting the slotted and non-slotted portions of said second dewatering means so as to adjust the length of said initial and final portions of said second dewatering stage.

18. The combination of claim 11 and wherein said first dewatering means has the construction of a forming table.

19. The combination of claim 18 and wherein a suction means cooperates with said forming table for providing a suction through the latter and through said first wire at said planar section thereof.

20. The combination of claim 11 and wherein said forming roll means includes a means for providing dewatering inwardly toward said forming roll means so that at the latter dewatering takes place simultaneously in opposite directions through first and second wires.

21. The combination of claim 11 and wherein within said second loop formed by said second wire there is a guide roll guiding said second wire where the latter travels into contact with the web at said second dewatering stage, and adjusting means operatively connected to the latter guide roll for adjusting the position thereof both longitudinally of said first wire and in a direction toward and away from the latter for determining both an angle between said first and second wires at said second dewatering stage and the location where said second wire initially contacts the web forming on said first wire at said second dewatering stage.

* * * * *